US007040416B2

(12) United States Patent
Collins

(10) Patent No.: US 7,040,416 B2
(45) Date of Patent: May 9, 2006

(54) T-POST HOLE-FORMING DEVICE AND USE FOR INSTALLING A T-POST

(76) Inventor: Herbert Warren Collins, 223 Big Sandy Rd., Elizabethton, TN (US) 37643

( * ) Notice: Subject to any disclaimer, the term of this patent is extended or adjusted under 35 U.S.C. 154(b) by 23 days.

(21) Appl. No.: 10/303,269

(22) Filed: Nov. 25, 2002

(65) Prior Publication Data

US 2003/0075359 A1 Apr. 24, 2003

Related U.S. Application Data

(63) Continuation-in-part of application No. 09/861,501, filed on May 18, 2001, now abandoned.

(51) Int. Cl.
*E21B 11/02* (2006.01)
*E21B 7/26* (2006.01)
*E21B 10/40* (2006.01)

(52) U.S. Cl. ..... 175/57; 175/19; 175/420

(58) Field of Classification Search ..... 175/19, 175/57, 293, 414, 420, 425
See application file for complete search history.

(56) References Cited

U.S. PATENT DOCUMENTS

| | | | | | |
|---|---|---|---|---|---|
| 299,086 | A * | 5/1884 | Over | 173/90 |
| 371,297 | A | 10/1887 | Becker | 175/414 |
| 538,382 | A | 4/1895 | Petree | 175/19 |
| 701,992 | A | 6/1902 | Bowen | 173/131 |
| 792,891 | A | 6/1905 | Furbee | 111/99 |
| 1,321,272 | A | 11/1919 | Jurich | 125/40 |
| 1,471,461 | A * | 10/1923 | Harmon | 30/168 |
| 2,086,213 | A * | 7/1937 | Collord | 405/244 |
| 2,098,146 | A * | 11/1937 | Hunt | 173/126 |
| 2,525,316 | A | 10/1950 | Schiff | 144/195.5 |
| 2,629,985 | A | 3/1953 | McDowell | 144/195.5 |
| 2,924,948 | A * | 2/1960 | Mueller | 405/236 |
| 3,276,820 | A * | 10/1966 | Ditson | 299/100 |
| 3,291,231 | A * | 12/1966 | Kammer | 175/170 |
| 3,401,760 | A * | 9/1968 | Balliano | 175/308 |
| 4,252,472 | A * | 2/1981 | Moraly | 405/244 |
| 4,279,104 | A * | 7/1981 | Classen | 52/38 |
| 4,801,128 | A * | 1/1989 | Taylor | 256/68 |
| 5,029,651 | A * | 7/1991 | Ubbink | 175/19 |
| 5,085,281 | A * | 2/1992 | Selly | 173/91 |
| 5,104,265 | A * | 4/1992 | Halloran, Jr. | 405/244 |
| 6,474,028 | B1 * | 11/2002 | Cusimano et al. | 52/153 |

* cited by examiner

*Primary Examiner*—Jennifer H. Gay
(74) *Attorney, Agent, or Firm*—Pamela M. Guy

(57) ABSTRACT

The invention provides a T-post hole-forming device, comprising (a) a shaft; (b) a head for receiving a driving force at the top of said shaft; (c) a flat plate affixed to one side of said shaft, the shaft terminating in a pointed end for piercing the ground. Also provided is a method for installing a T-post into the ground. The method involves (a) piercing the ground with the T-post hole-forming device to produce a hole; (b) removing the device from the ground, and (c) inserting a T-post into the hole, thereby installing the T-post into the ground.

3 Claims, 4 Drawing Sheets

T-POST HOLE-FORMING DEVICE AND USE FOR INSTALLING A T-POST

This application is a continuation-in-part of U.S. application Ser. No. 09/861,501, filed May 18, 2001, now abandoned, which is incorporated herein by reference.

BACKGROUND OF THE INVENTION

T-posts are commonly used as supports for wire fences. They are characterized by their "T" shaped cross-section and have blunt ends, which are generally driven into the ground by applying either manual or machine force to the top of the post. The force is used to drive the T-post to a desired depth in the ground.

Under certain unfavorable circumstances, such as when the ground into which the T-post is being inserted abounds with rocks, T-post installation can be fraught with problems. One type of problem that can occur when driving a T-post into the ground is striking of a descending T-post into a rock or other obstacle in the ground, causing the post to become misaligned so that the post is not sufficiently straight. Because of the "T" shape of the posts, they are difficult to reposition and a misaligned T-post generally must be removed from the ground by force. Another type of problem that can occur is blockage of the descent of the T-post due to a rock or other obstacle in the ground. In this situation, the remedy is to remove the T-post from the ground, and select another location for re-inserting the post.

The process of removing a T-post from the ground can be difficult and time-consuming, and can cause damage to the T-post. Often, the process of removing a T-post from the ground causes bending of the post, rendering it unsuitable as a support for fencing. Moreover, the typical method used to both drive in and remove T-posts from the ground requires work to be performed above shoulder level. This overhead work is both inefficient and fatiguing.

Thus, there exists a need for a device that prepares the ground for insertion of a T-post. The present invention satisfies this need and provides related advantages as well.

SUMMARY OF THE INVENTION

The invention provides a T-post hole-forming device. The device comprises a shaft that terminates in a pointed end for piercing the ground; a head at the top of the shaft for receiving a driving force; and a flat plate affixed to one side of the shaft. In one embodiment, the device is constructed from a metallic material, such as steel.

The invention also provides method for installing a T-post into the ground. The method involves (a) piercing said ground with the T-post hole-forming device, which comprises a shaft that terminates in a pointed end for piercing the ground; a head at the top of the shaft for receiving a driving force; and a flat plate affixed to one side of the shaft, (b) removing the device from the ground, and (c) inserting the T-post into the hole, thereby installing the T-post into the ground.

DETAILED DESCRIPTION OF THE INVENTION

Figure 1:
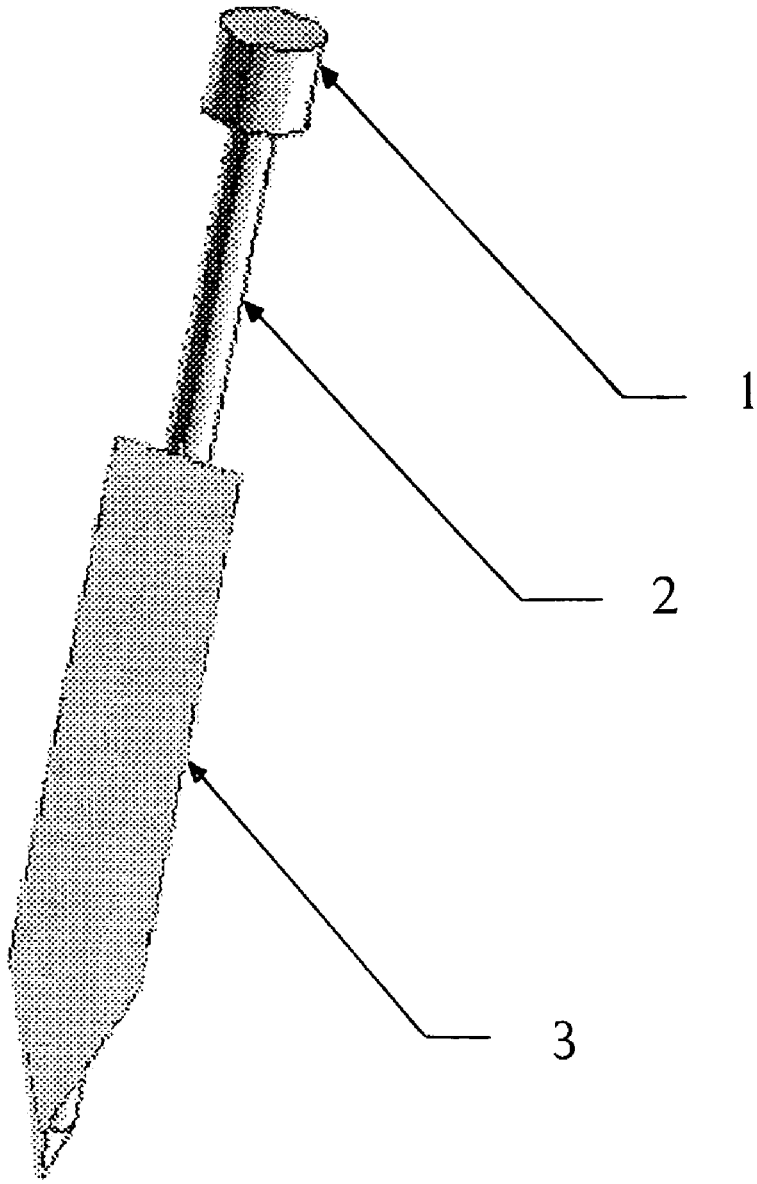
FIG. 1 shows a three-dimensional view of an exemplary T-post hole-forming device, with the head 1, shaft 2 and plate 3 indicated.
Figure 2:
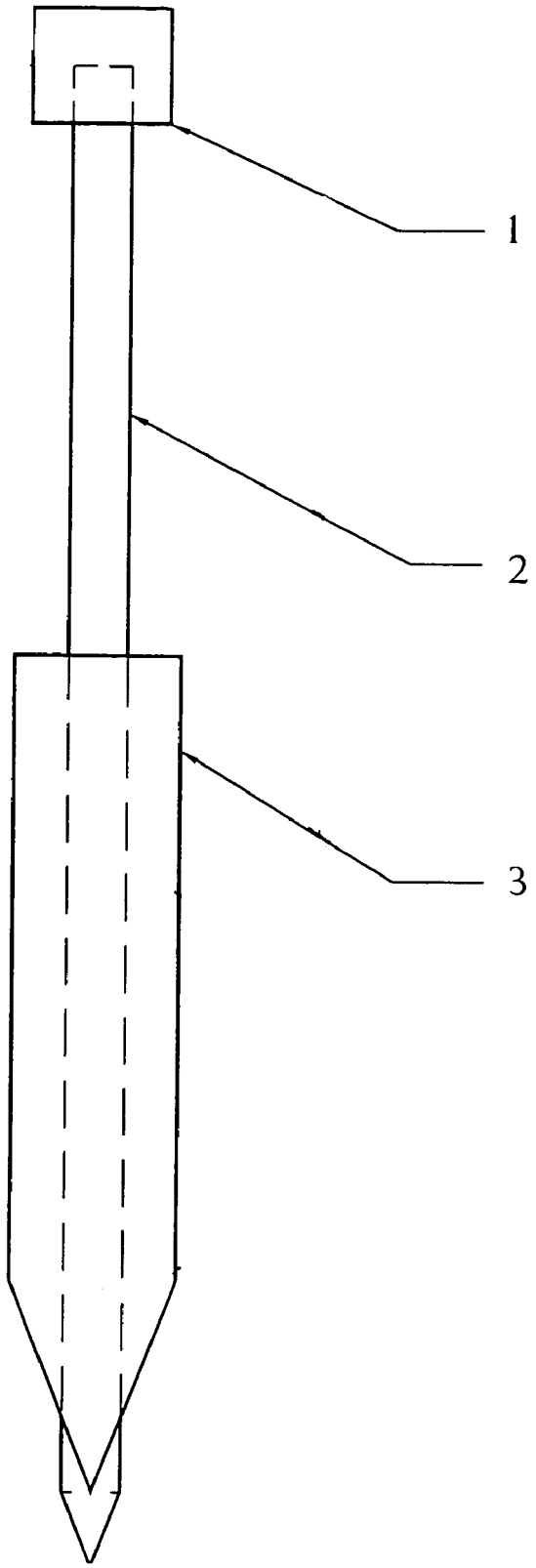
FIG. 2 shows the front view of an exemplary T-post hole-forming device, with the head 1, shaft 2 and plate 3 indicated.
Figure 3:
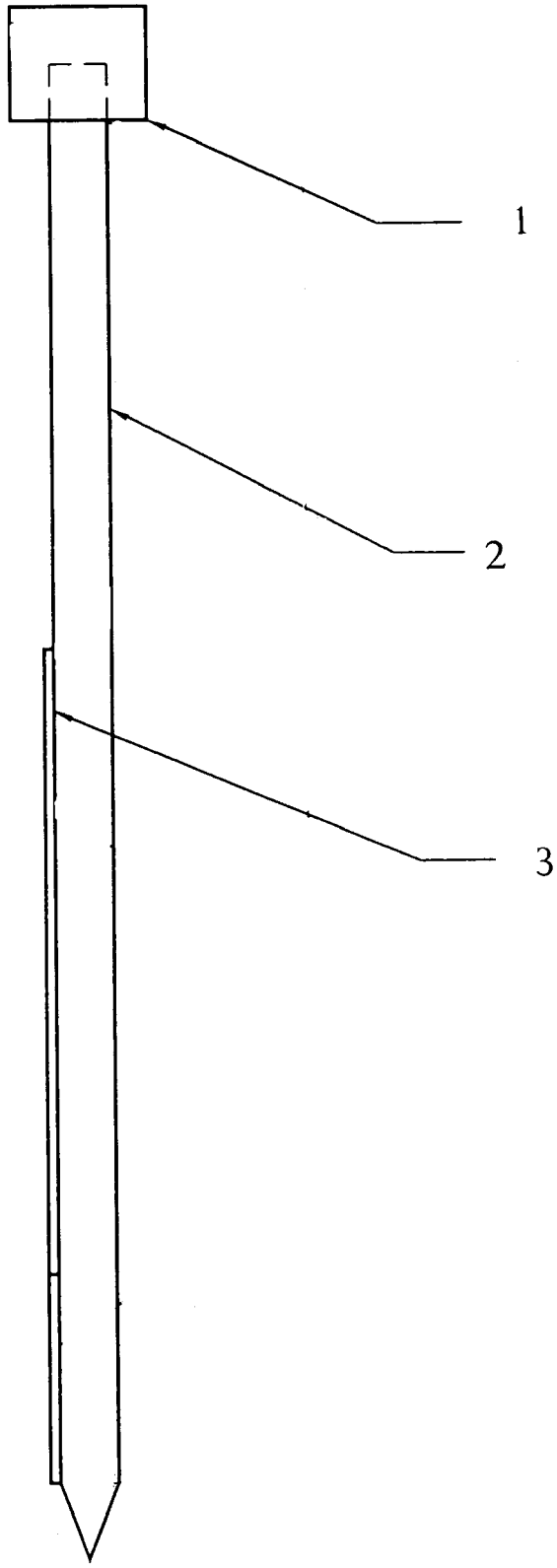
FIG. 3 shows the side view of an exemplary T-post hole-forming device, with the head 1, shaft 2 and plate 3 indicated.

This invention relates to a device useful for preparing the ground to receive a T-post, and thus is useful in a method for installing T-posts.

The invention provides a device for forming a hole in the ground for insertion of a T-post. The T-post hole-forming device has a shaft 2; a head 1 at the top of the shaft 2 for receiving a driving force; and a flat plate 3 affixed to one side of the shaft 2, the shaft 2 terminating in a pointed end for piercing the ground. The combination of the shaft 2 and flat plate 3 affixed to one side of the shaft 2, when driven into the ground, form a hole of ideal shape for insertion of a T-post. Moreover, the device can be flexibly maneuvered in the ground, unlike a T-post. As such, when ground conditions are unfavorable for inserting a T-post directly into a desired location, for example, due to the presence of rocks in the soil, the device can be employed to form a T-post receiving hole in a desired location. Flexible maneuvering of the device is achieved because the lower portion of the device, from the pointed end to the flat plate, does not have the "T" shape and can be shifted without friction caused by the "T" shape. In addition, the device, when driven into the ground, produces a hole shape ideal for insertion of a T-post because the combination of the shaft and flat plate have cross-section similar to a "T" shape.

Diagrams of an exemplary T-post hole-forming device are shown in FIGS. 1 through 4.

The shaft 2 of a device of the invention can be constructed of a variety of materials of suitable strength for being driven into the ground by manual or machine force. Exemplary materials suitable for the shaft 2 of a T-post hole-forming device of the invention include metallic materials, such as steel, aluminum alloy, titanium alloy, nickel alloy, and composite materials, such as high-strength carbon fiber-epoxy, high-modulus carbon fiber-epoxy, E-glass fiber-epoxy, boron fiber alloy and the like.

The head 1 and flat plate 3 of a device of a device of the invention can be similarly constructed of a variety of materials, for example, metallic materials, such as steel, aluminum alloy, titanium alloy, nickel alloy, and composite materials, such as high-strength carbon fiber-epoxy, high-modulus carbon fiber-epoxy, E-glass fiber-epoxy, boron fiber alloy and the like.

A material suitable for producing the claimed device can be selected by one skilled in the art, based on properties, such as strength, impact resistance, tensile strength, specific gravity, fiber content, fiber orientation and tensile modulus, of various well known materials.

The shaft 2 of a T-post hole-forming device of the invention can have a variety of diameters, which can depend upon the material selected for construction of the shaft 2. As a non-limiting example, when a metallic material such as steel is used to construct the shaft 2, a diameter of about 1 to 2 inches provides sufficient strength for being driven into the ground by manual or machine force. In one embodiment, the shaft 2 of a T-post hole forming device of the invention has a diameter of about 1.5 inches. Those skilled in the art recognize that the shaft 2 of a T-post hole-forming device of the can be smaller, such as less than about 1 inch, or larger, such as greater than about 2 inches.

The shaft 2 of a T-post hole forming device of the invention can have a variety of lengths, which can depend upon the material selected for construction of the shaft 2 and upon the height of the individual using the device. As a non-limiting example, a shaft 2 of a T-post hole-forming device of the invention can have a length of about 30 to 50 inches, such as about 35 to 45 inches, or about 30 to 40 inches. For example, a shaft 2 of a T-post hole-forming device of the invention can have a length of about 36, 37, 38, 39, 40, 41 or 42 inches. In one embodiment, the shaft 2 has a length of about 39.5 inches. Those skilled in the art recognize that the shaft 2 of a T-post hole-forming device of the invention can be shorter, such as less than about 30 inches, or longer, such as greater than 50 inches.

The head 1 of a device of the invention can have a variety of dimensions. The dimensions of the head 1 can depend upon the dimensions of the mallet, sledgehammer, machine or other driver to be used with the device. The head 1 of a T-post hole-forming device of the invention can have any shape, including circular, square, rectangular, rhomboid, polygon and spherical, that can receive a manual or mechanical force. As a non-limiting example, the head 1 of a device of the invention can be, if circular, about 3 to 7 inches in diameter, such as about 3, 4, 5, 6 or 7 inches. In one embodiment, the head 1 has a length of about 3.5 inches in diameter. Those skilled in the art recognize that the head 1 of a T-post hole-forming device of the invention can have a smaller diameter, such as less than about 3inches, or a larger diameter, such as greater than about 7inches. A head 1 that is a shape other than circular can have a surface area similar to those described above with respect to a circular design, such as a surface area of about 5 to 20 square inches.

A flat plate 3 of a device of the invention, which is affixed to one side of the shaft 2, can have a variety of dimensions. The length of the flat plate 3 can be selected based on the range of depths to which the device will be driven into the ground. Because the flat plate 3 creates a hole of suitable shape for insertion of a T-post, it is advantageous to design the device to have a flat plate sufficient to penetrate the ground to the desired depth to which the T-post is to be inserted. As a non-limiting example, a flat plate 3 can have a length of about 20 to 25 inches, such as about 21 to 24 inches, about 22 to 23 inches, or about 21 22, or 23 inches. In one embodiment, the flat plate 3 has a length of about 22 inches. Those skilled in the art recognize that the flat plate 3 of a T-post hole-forming device of the invention can be shorter, such as less than 20 inches, or longer, such as greater than about 25inches.

Similarly, the width of the flat plate 3 can be designed such that a hole suitable for insertion of a T-post is formed. Thus, the width of the flat plate 3 can depend upon the size of the T-post used. As a non-limiting example, a flat plate 3 can have a width of about 3 to 7 inches, such as about 4 to 6inches, or about 5 inches. Those skilled in the art recognize that the width of the flat plate 3 of a T-post hole-forming device of the invention can be shorter, such as less than about 3 inches, or longer, such as greater than about 7 inches.

The flat plate 3 can have a variety of shapes. As a non-limiting example, it can have square edges (90 degree edges); can have rounded edges; or can have edges that form a pointed shape, such as a triangular shape. A triangular shape terminating in a point can provide reduced resistance to penetration into ground compared to square edges. Therefore, in one embodiment, the flat plate 3 has two 90 degree angles at the top end, and is triangular at the bottom end, with a point in the same direction as the pointed end of the shaft.

The pointed end of the shaft 2 of a device of the invention can have a variety of dimensions so long as it can pierce the ground into which it is driven to form a hole suitable for inserting a T-post. The pointed end of the shaft 2 generally has a length of about 1 to 4 inches, such as about 2 to 3inches. In one embodiment, the pointed end of the shaft 2 is about 2 inches. The length of the pointed end of the shaft 2 can be designed to be effective in a particular type of ground. As a non-limiting example, a length of about 2 inches has been well-suited for soil abounding with small rocks. Those skilled in the art recognize that the pointed end of a T-post hole-forming device of the invention can be shorter, such as less than about 1 inch, or longer, such as greater than about 4inches.

The head 1, shaft 2, flat plate 3 affixed to one side of the shaft 2 and the pointed end of the shaft 2 can be constructed as a single piece, or can be assembled from component parts. As a non-limiting example, the shaft 2 can be a single piece to which the head 1 and flat plate 3 are attached. The method used for attaching component parts will depend upon the material used for the particular parts. As a non-limiting example, if a metallic material is used, welding of component parts to each other is a suitable method for assembly of the device. As another non-limiting example, if a composite or polymeric material is used, a molding process is a suitable method for forming the device. The device can be molded, for example, as a unit, or parts of the device can be molded separately and later assembled. Component parts of the device can be made from different materials, as is recognized by those skilled in the art.

The invention provides a method for installing a T-post into the ground. The method involves (a) piercing the ground with the T-post hole-forming device to produce a hole, (b) removing the device from the ground, and (c) inserting the T-post into the hole. In one embodiment, the ground pierced by the device is rocky ground.

Figure 4:
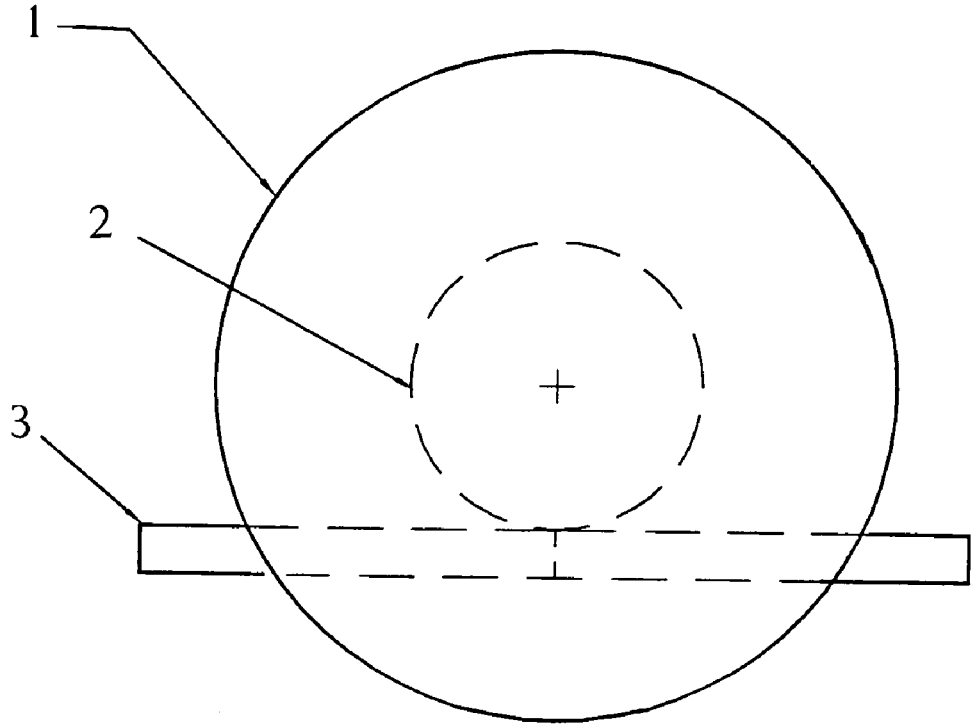
FIG. 4 shows the top view of an exemplary T-post hole-forming device, with the head 1, shaft 2 and plate 3 indicated.

By piercing the ground with the T-post hole-forming device of the invention, a hole of proper dimension to accept a T-post is formed. Such a hole is shaped to receive the "T" shape of the T-post because of the T-like shape of the device formed by the flat plate affixed to the shaft. A cross-section of a device of the invention, shown in FIG. 4, shows the T-like shape of bottom portion of the device, which penetrates the ground.

Once a hole is formed, the device is removed from the ground. Whereas it is generally difficult to remove a T-post from the ground due both to the height and structure of the post, a T-post hole-forming device of the invention can be relatively easily removed from the ground without any over-shoulder-level exertion on the part of the individual removing the device from the ground.

Upon removing the T-post hole-forming device of the invention from the ground, the T-post is inserted into the prepared hole. Securing of the T-post once inserted is performed by well known procedures, which will depend on the particular purpose of the T-post.

As used herein, the term "rocky ground" means soil, dirt, clay or other natural fill that contains stones or rocks. The term refers to ground that can contain rocks of various sizes, but generally refers to ground predominantly containing rocks that can be shifted by manual or mechanical force applied by the T-post hole-forming device of the invention. The term also refers to ground that contains large rocks that cannot be shifted by manual or mechanical force applied by the T-post hole-forming device of the invention. The ability of the claimed T-post hole-forming device to shift once inserted into the ground is an advantage of the device, in comparison to a T-post, because the device can be inserted into the desired position by adjusting the location of one or more rocks that can be moved with respect to the device, or by adjusting the location of the device with respect to immovable rocks.

It is understood that modifications which do not substantially affect the activity of the various embodiments of this invention are also included within the definition of the invention provided herein. Accordingly, the following examples are intended to illustrate but not limit the present invention.

EXAMPLE I

Installation of a T-post in Rocky Ground

This example shows a method for easily installing a T-post into rocky ground.

To install T-posts in the rocky soil of northeastern Tennessee, the T-post hole-forming device was used to prepare holes. The T-post hole-forming device was positioned over a selected location, force was applied to the head of the device using a sledgehammer, and the pointed end of the device pierced the ground. Upon the second application of force with the sledgehammer, the device encountered a rock in the soil. The device was then slightly repositioned without withdrawal from the ground, and application of force with the sledgehammer resumed. The device was driven into the rocky ground to a depth of approximately 20 inches. Because of the T shape of the device, upon removal of the device from the ground, a hole suitable for accepting a T-post was formed. The T-post was then inserted by hand into the T shaped hole.

Whereas previous installation of T-posts into the rocky ground was problematic due to bending of posts that encountered small rocks, as well as failure of posts to install to the correct depth due to small rocks, the T-post hole driver made installation fast and easy, as well as economical, because no T-posts were damaged during installation when the T-post hole driving device was used. Moreover, the T-post hole driving device eliminated the need to apply force at shoulder level, reducing physical exertion on the part of the installer. Because the T-post hole driver can be made to a desired length, a length of about waist height was used. This allowed optimal transfer of manual force to the head of the device.

In sum, the T-post hole-forming device provides less expense, by reducing waste of T-posts due to accidental bending upon installation; less physical effort, by allowing the driving force to be applied below shoulder-level; and less time expended, by eliminating the need to reinstall T-posts when installation is interrupted by a rock in the ground.

Although the invention has been described with reference to the disclosed embodiments, those skilled in the art will readily appreciate that the specific application described is only illustrative of the invention. It should be understood that various modifications can be made without departing from the spirit of the invention.

What is claimed is:

1. A method for installing a T-post into ground, comprising:

(a) piercing said ground with a T-post hole-forming device to form a hole, the device comprising
  (i) a shaft;
  (ii) a head for receiving a driving force, said head being positioned at the top of said shaft, and
  (iii) a flat plate affixed to one side of said shaft and not in contact with said head, said shaft terminating in a pointed end for piercing the ground and said flat plate terminating above said pointed end;

(b) removing said device from the ground, and (c) inserting a T-post into said hole, thereby installing said T-post into said ground.

2. The method of claim 1, wherein said ground is rocky ground.

3. A method for installing a T-post into ground, comprising:

(a) piercing said ground with a T-post hole-forming device comprising (i) a steel shaft having a diameter of about 1.5 inches;
  (ii) a steel head for receiving a driving force attached to the top of said shaft, said head having a diameter of about 3.5 inches, and (iii) a steel flat plate having a length of about 22 inches affixed to one side of said shaft and not in contact with said head, said shaft having a pointed end section of about 2 inches in length for piercing the ground, wherein said plate terminates about 2 inches from the pointed end of said shaft (b) removing said device from the ground, and (c) inserting a T-post into said hole, thereby installing said T-post into said ground.

* * * * *